United States Patent [19]

Sabala

[11] Patent Number: 4,951,405

[45] Date of Patent: Aug. 28, 1990

[54] APPARATUS FOR INTERCHANGEABLE OUTDOOR ILLUMINATED SIGNS

[76] Inventor: Edwin K. Sabala, 14100 Walsingham Rd., No. 20, Largo, Fla. 34644

[21] Appl. No.: 172,261

[22] Filed: Mar. 23, 1988

[51] Int. Cl.[5] ..... G09F 13/28

[52] U.S. Cl. ..... 40/551; 40/545; 40/547

[58] Field of Search ..... 40/551, 550, 547, 576, 40/578, 552, 545

[56] References Cited

U.S. PATENT DOCUMENTS

| | | | |
|---|---|---|---|
| 1,203,582 | 11/1916 | Chase | 40/551 |
| 1,251,471 | 1/1918 | Brooks | 40/551 |
| 1,462,156 | 7/1923 | Trucksess | 40/551 |
| 1,760,767 | 5/1930 | Muller | 40/541 |
| 1,782,564 | 11/1930 | Coufal et al. | 44/552 |
| 1,784,677 | 12/1930 | Morton | 40/576 |
| 1,914,161 | 6/1933 | Pistocco | 40/550 |
| 2,424,169 | 7/1947 | Hoffman | 434/169 |
| 2,499,049 | 2/1950 | Yates | 40/576 |
| 2,520,243 | 8/1950 | Hoffman | 40/576 |
| 2,801,483 | 8/1957 | Cooper et al. | 40/545 |
| 3,080,491 | 3/1963 | Howell | 307/117 |
| 3,221,432 | 12/1965 | Gold | 40/551 |
| 3,289,005 | 11/1966 | Prescott et al. | 250/239 |
| 3,553,870 | 1/1971 | Rudolph | 40/576 |
| 4,009,535 | 3/1977 | Stock | 40/546 |
| 4,028,828 | 6/1977 | Chao et al. | 40/552 |
| 4,532,579 | 7/1985 | Merryman | 362/239 |
| 4,587,753 | 5/1986 | Harper | 40/451 |
| 4,611,265 | 9/1986 | Davis | 362/145 |

FOREIGN PATENT DOCUMENTS

| | | | |
|---|---|---|---|
| 580272 | 7/1933 | Fed. Rep. of Germany | 40/552 |

*Primary Examiner*—Cary E. Stone

*Attorney, Agent, or Firm*—Charles E. Lykes, Jr.

[57] ABSTRACT

An apparatus for providing attractive and customized illuminated signs, the apparatus comprising a shroud for the mounting of desired letters, numbers, or other designs, a set of figures for mounting upon said shroud and a means for transmitting illumination energy through said shroud to said figures for illumination. The apparatus may be enhanced by a mounting mechanism and a photoelectric cell to facilitate more efficient and convenient outdoor use.

16 Claims, 9 Drawing Sheets

APPARATUS FOR INTERCHANGEABLE OUTDOOR ILLUMINATED SIGNS

BACKGROUND OF THE INVENTION

The invention relates to outdoor and indoor illuminated signs, particularly those useful in smaller businesses and individual residences to identify addresses.

A number of inventions teach apparatus and methods for providing an illuminated display for the letters and numerals of identifications of addresses and business identities. Most of this prior art, however, concerns articles which are specifically prepared for a single display and cannot be readily changed to make a different display.

U.S. Pat. No. 4,611,265, issued to *Davis* (9/9/86) teaches a lighted address display in which the light from an incandescent bulb is reflected into a translucent wall upon which address indicia appear. The invention teaches the use of opaque, stick-on numerals to form the address figures.

U.S. Pat. No. 4,009,535, issued to *Stock* (3/1/77) teaches the illumination of a plastic template in which the desired figures are cut out. By illuminating one side of the plastic template light will pass through the cutouts and be visible in the shape of the desired figures on the other. Once such a template is cutout the only way to change the display would be to create a new template.

What is not available in the present art is a means of providing an attractive illuminated sign which is capable of wide interchangeability of characters and designs and capable of outdoor display. The presently available efforts at such an objective typically result in large, inefficient displays which are capable of accomodating only a relative few styles, sizes and designs of figures.

SUMMARY OF THE INVENTION

The present invention overcomes many of the limitations of the prior art in providing an attractive, customized letter, numeral, or other figure display, while still permitting free interchange and substitution between letters and numerals. The basic form of the invention exists in two alternative embodiments.

The first such embodiment generally comprises a mounting shroud, within which electrical communication between the mounting shroud and the mounted letters, numerals, or characters is facilitated. The second embodiment generally comprises a mounting shroud within which light energy is generated and passed into the letters, numerals, and characters adapted to be illuminated.

In the first embodiment, an elongated mounting member is provided which generally comprises an elongated housing member within which electricity is passed along to two or more sliding tracks which also serve as holding members. Each such track is electrically oriented to have an electrical potential difference with the other track and is constructed of a conducting material so that they can, together, act as a source of electrical energy for a light fixture.

Letters, numerals, or characters are provided with two conducting held members which are designed to fit snugly into the holding member tracks and electrically communicate with them. The letter, numeral, or character is either constructed of or equipped with electrical lighting in the shape of the letter, numeral, or character to be displayed. When such a displayed figure is mounted and electrical power is supplied to the mounting holding member tracks, the electrical lighting illuminates and provides a lit displayed figure.

Any number of such figures as will fit may be placed along the holding member tracks to create the desired display. In order to provide protection from the elements of weather, stripping can be provided to fill in any portions of track not filled in by display figures. The device may also be enhanced by providing a photo-electrical cell in communication with an on-off array in order to achieve automatic activation of the device during hours of darkness.

In the second general embodiment of the invention, an elongated housing member shrouds a light source, such as a fluorescent light, neon light, or a series of incondescent lights. The holding and mounting means comprise one or more slots or openings through which the light can be passed.

The display figures are constructed, in whole or in part, of a light transmissive material and may be affixed to the mounting members by one or more light transmissive held prongs which are designed to snugly fit into the mounting and holding tracks. Those prongs are adapted to capture light from within the mounting member and transmit it to the display figure, thus illuminating the display figure. As required, this task may be facilitated by mirrors, optical bars, optical fibers, and other optical devices in order to ensure full illumination of even complex or detailed figures. Again, potentially exposed figures of track may be covered with tape or stripping, both as weatherproofing and to prevent the undesired escape of light energy.

These embodiments of the invention can be seen to provide a number of advantages over the prior art.

First, such embodiments permit the fashioning of a sign with a customized appearance from mass produced parts. By providing mounting members fitted with only several convenient and standardized track dimensions, it will be possible to manufacture any number of sizes and styles of letters and numerals designed to fit them. Then the purchaser could easily change his display by simply purchasing new letters or figures as desired. It would still be possible to satisfy more customized requirements by having the more unique features of a display, such as trade emblems or logos, custom made with held members to fit the mounting holding tracks.

Another advantage of the invention is its versatility in providing styles of display. The mounting holding member can be shaped in any desired manner, such as a horizontal or vertical line, diagonal, or an arc.

It is an object of the invention to provide a simple means of illuminating display figures, such as addresses or individual and business identifications, including logos, which permit a free interchange of the figures.

It is a further object of the invention to provide such an interchangeable illuminating display means which is weatherproof and otherwise suitable for outdoor display.

It is a further object of the invention to provide such an interchangeable illuminating display means which is automatically activated during hours of darkness. It is a further object of the invention to provide such an interchangeable illuminating display means in which figures are illuminated by a series of electric lights defining the desired figure.

It is a further object of the invention to provide such interchangeable illuminated display figures which are all illuminated by a single source of light.

It is a further object of the invention to provide a means of securely mounting illuminated figures to be displayed outdoors in a manner so as to be substantially unaffected by the wind and moisture.

Other features and advantages of the present invention will be apparent from the following description in which the preferred embodiments have been set forth in conjunction with the accompanying drawings.

DETAILED DESCRIPTION OF THE PREFERRED EMBODIMENTS

Figure 1:
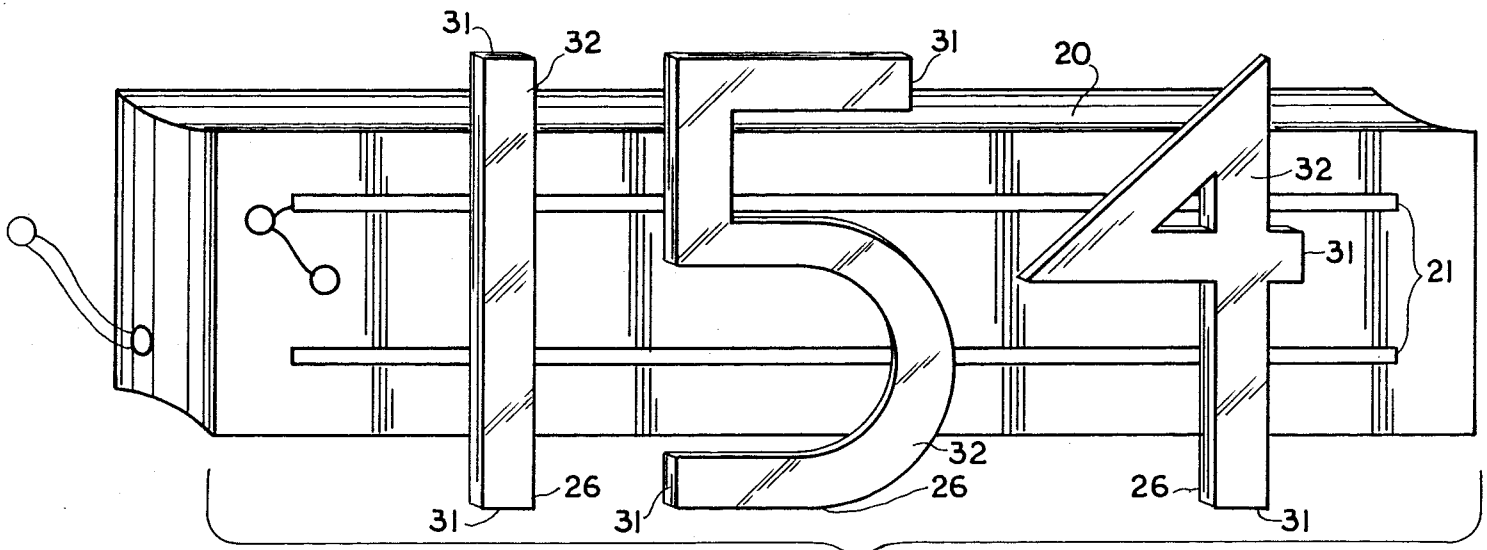
FIG. 1 depicts a front view of the shroud apparatus with numerals for illumination.
Figure 3:
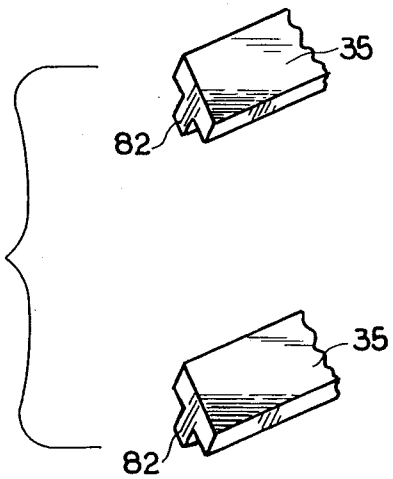
FIG. 3 depicts strips useful in filling in open spaces in the slotted tracks.

In describing the preferred embodiments of the invention, reference will be made to FIGS. 1 through 11 . In the preferred embodiment of the invention, the illumination energy transmitted to the figures may either be electrical for conversion into light by the figure itself or at the surface of the figure, or it may be optical energy wherein such visible light is transmitted to the figure for display.

First an electrical energy version of the invention will be described by making reference to FIGS. 1 through 6. An elongated shroud (20) made of a non-conducting material is adapted with two slotted tracks (21) which run-down the length (22) of the shroud (20) parallel to each other. The slotted tracks (21) house an exposed electrically conducting material (24).

Electrical energy is transmitted into the shroud (20) by one or more insulated conducting wires (25) which are connected to the exposed electrically conducting material (24) within the slotted tracks (21) such that the insulated conducting wires (25) can be used to transmit electrical energy of different potentials to the exposed electrically conducting material (24) within the slotted tracks (21). This can be done by connecting one or more of the insulated conducting wires (25) to each of the track electrical conductors (24). Then each conducting wire can be connected to various electrical potentials, ground, or a source of alternating current.

Figures for electrical illumination (26) are adapted with mounting appendages (27) which are spaced apart exactly the same distance as the slotted tracks (21). The mounting appendages (27) are adapted to snugly fit within the slotted tracks (21) to hold a figure (26) upon it. Each mounting appendage (27) is further adapted with an electrical conducting piece (29) which is adapted to make direct contact with its respective track electrical conductor (24).

Figure 2:
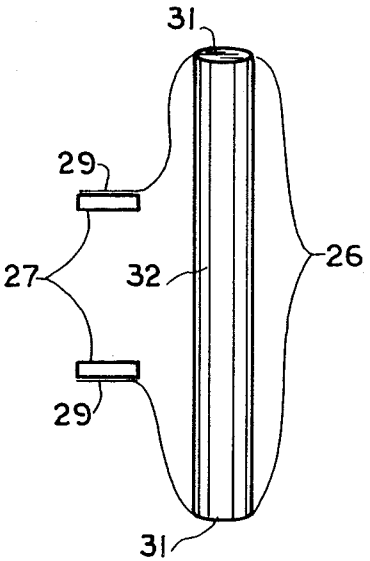
FIG. 2 depicts a side view of an isolated numeral for illumination.
Figure 4:
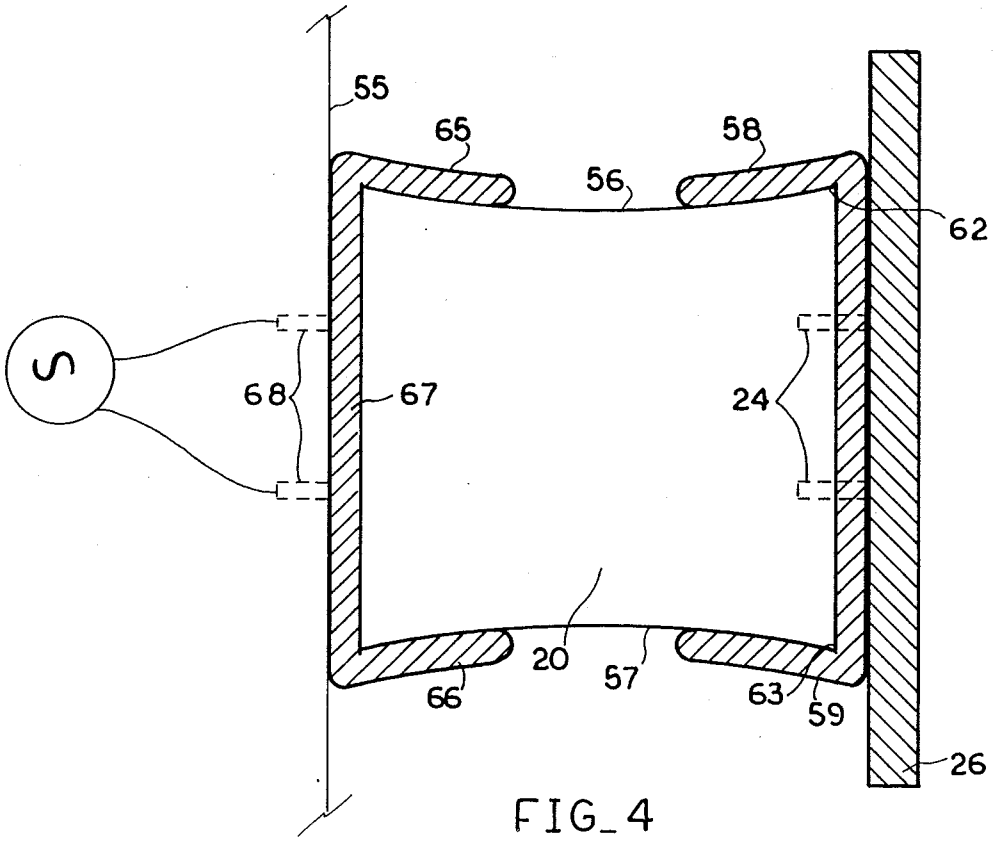
FIG. 4 depicts a cross-sectional view of an elongated shroud with wall and illumination figure mounting members.

The figure (26) itself as depicted FIGS. 1 and 2 is composed of a shaped neon light. A tubular neon light (32) may be shaped into a desired figure (26) for illumination. As required, electrical energy from each of the mounting appendages (27) is delivered to the terminals (31) of the neon light (32) for the purpose of illuminating the light (33).

This version of the invention is subject to modification in the means of delivering electrical energy to the illuminated figures (26). Rather than having two electrical track conductors, it would be possible to use only one electrical track conductor and provide a grounding mechanism within the shroud such that each figure could be electrically grounded in a manner to permit electrical current to flow from one electrical track conductor, through the electrically illuminated figure, and then to ground. Also two slotted tracks and three electrical track conductors could be provided. In this manner three phase current could be used. This would facilitate the application of the principles of this invention to large signs requiring the consumption of greater amounts of power and providing for larger and brighter displays for such things as billboards, strip mall store signs, and other situations wherein viewing illuminated signs over larger distances is desired.

Outdoor display of such illuminated figures upon such a shroud (20) would result in the exposure of the electrical track conductors (24) to the atmosphere, including any precipitation. This could result in a malfunction, such as a short circuit. Also, the slotted track (21) may appear unsightly.

Figure 6:
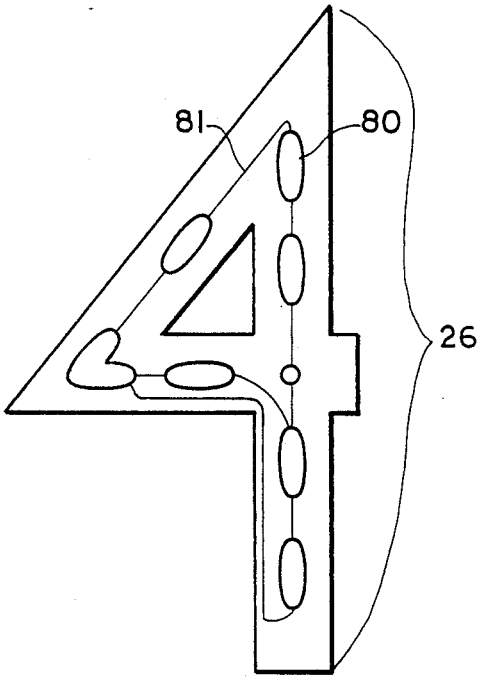
FIG. 6 depicts an illumination figure which is equipped with a series of incandescent bulbs defining a desired numeral.
Figure 7:
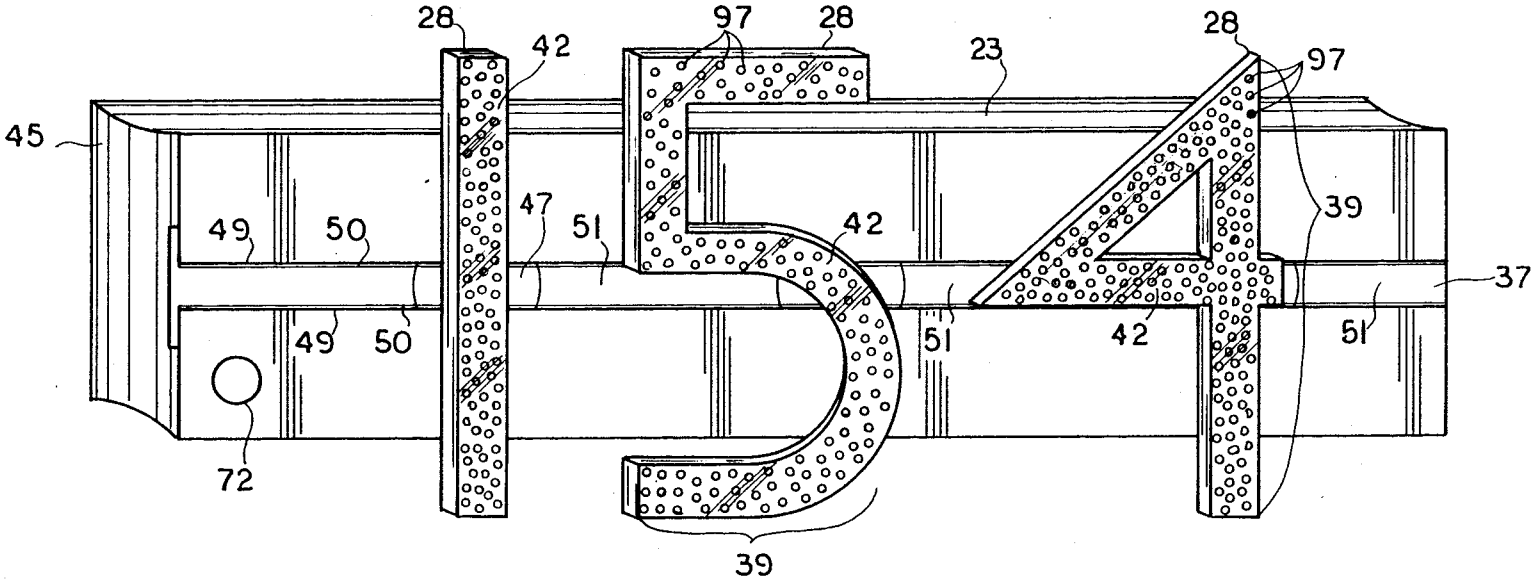
FIG. 7 depicts an illumination figure which is equipped with fiberoptic ends defining a desired numeral.
Figure 9:
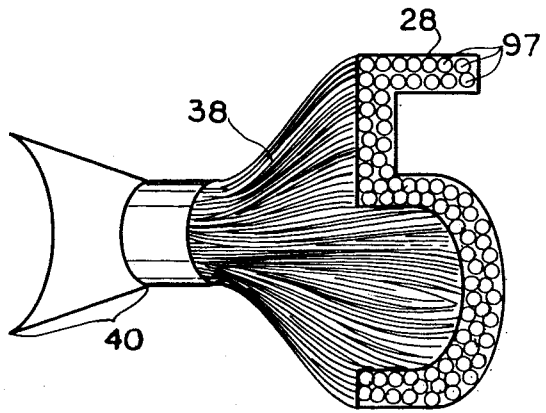
FIG. 9 depicts the bundled optical fibers spread into an array defining a desired numeral.
Figure 8:
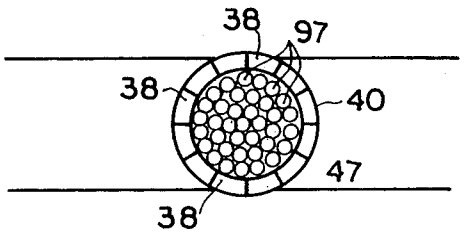
FIG. 8 depicts the cross-section of the bundle of optical fibers transmitted through the opening in the shroud.
Figure 10:
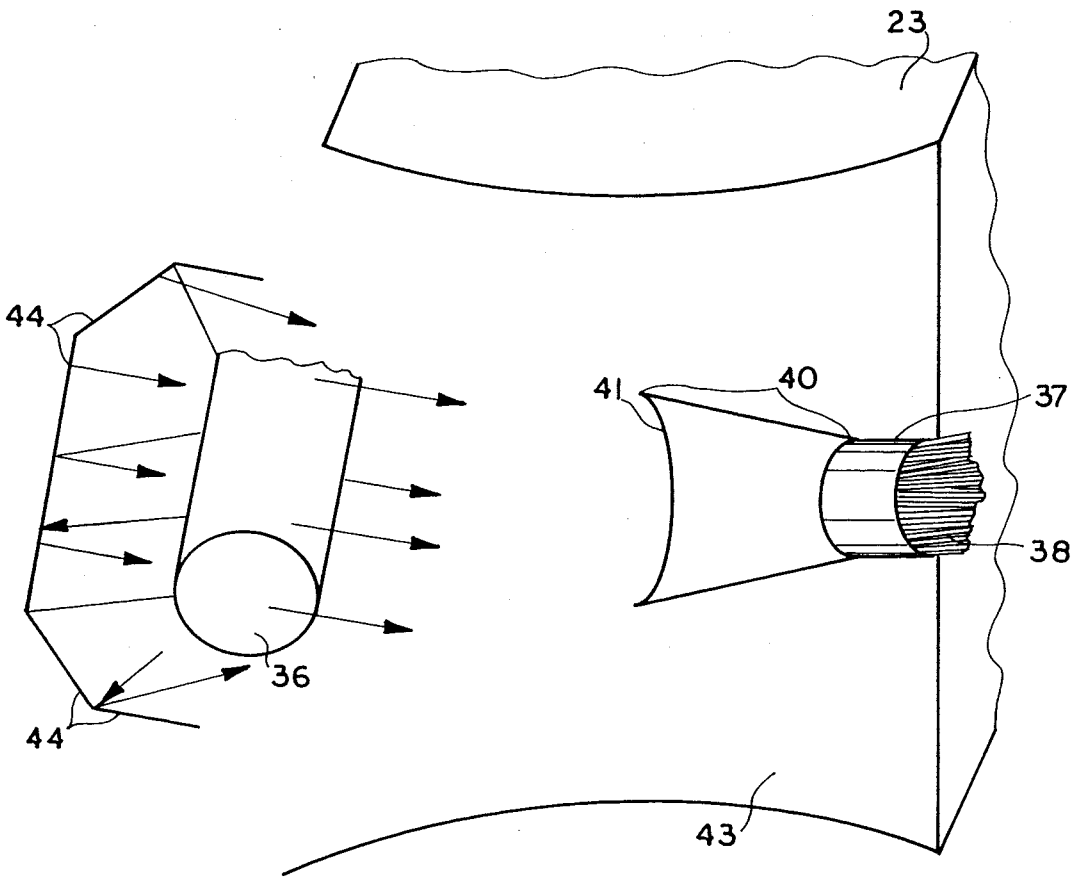
FIG. 10 depicts a cut away view of the interior of a shroud adapted with a light source, mirrors, and light transmissive bar for transmitting light through the shroud opening.
Figure 11:
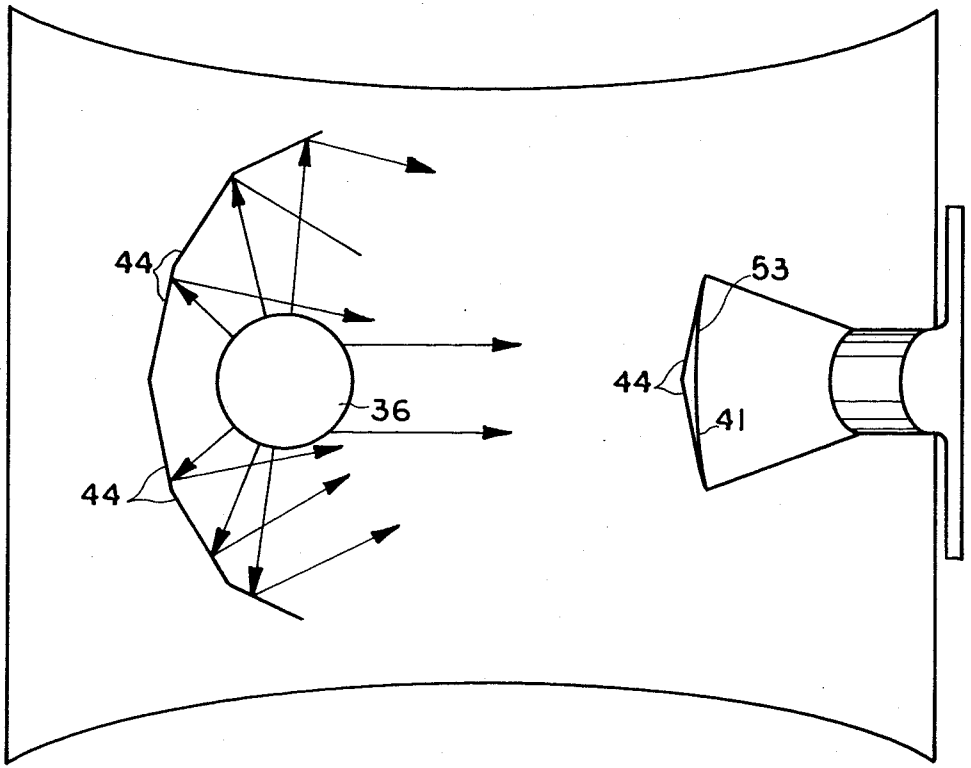
FIG. 11 depicts a cross-sectional view of the shroud with light transfer means and an illumination figure.

In order to deal with either situation, the slotted track may be partially covered by a fitted strip (35) which is adapted with a series of appendages (28) designed to fit within the slotted track (21). The desired numeral, letter, or figure may also be defined by providing a series of incandescent bulbs (80) in the desired shape as depicted in FIG. 6. The electricity delivered through the shroud (20) by means of the electrical conductors (24) in the slotted tracks (21) is transmitted through a wire (81) in the desired figure (26) connecting a series of incandescent bulbs (80) defining the desired shape. When the electricity is delivered to the slotted track conductors (24), the desired array illuminates in the definition of the desired shape. Such a strip could be cut to precisely fill any exposed portions of slotted track (21) left open after one or more figures (26) have been placed along the slotted track (21).

In another version of this embodiment (FIGS. 7 through 11) the figures are lit from a common source of optical energy. In this embodiment the shroud houses a source of light energy and the light is transmitted to figures.

In such an embodiment, an elongated opaque shroud (23) is adapted to carry or house a source of light, such as a fluorescent light (36). One or more elongated tracks (37) are adapted with means for attaching figures (28) in such a manner as to permit light to pass through the elongated track (37) and into the figure (28).

The figures (28) for this embodiment are constructed of or adapted with a light transmissive material, such as a series of optical fibers (38) which are arranged so as to cause the transmitted light to radiate in the desired figure array (39).

One means of accomplishing this objective is by adapting each figure (28) for illumination with a light transmissive bar (40). The bar is further adapted with a concave surface which can be inserted within the shroud (23) and directed so as to be exposed to the greatest possible volume of light. The light transmissive bar (40) is then tapered into a cylindrical section whose diameter matches exactly the width of the slotted track along the shroud. On the other side of the light transmissive bar (40) from the concave surface (41), the light transmissive bar (40) is split into numerous optical fibers (38). These optical fibers (38) are then positioned so that their light emitting ends (97) are positioned to define the desired numeral, letter, or other design (39). There are sufficient optical fibers (38) provided to permit the light from the light transmissive bar (40) to be moved into a variety of letters, numbers, or other forms and designs.

The dimensions and materials of the light transmissive bar (40), optical fibers (38), and the figure (28) are selected such that the light passing into the light transmissive bar (40) can be trapped within the transmission system described by the critical angle of the materials involved until the light is passed through the visible ends (42) of the optical fibers (38). By appropriately shaping the interior of the opaque shroud (43) and providing mirrors (44) therein, it is possible to direct most of the light from the fluorescent light (36) into the concave surface (41) of the light transmissive bar (40).

The figure apparatus thus described is easily installed into an opaque shroud (23) which can be opened at one end (45). The cylindrical portion (47) of the light transmissive bar (40) is inserted into the slotted track (21) such that the concave surface (41) is in the interior portion of the opaque shroud (43) and the figure (28) is on the outside. The figure (28) can be slid down the slotted track (21) to any desired position. Because the portion (47) held between the edges of the track is cylindrical, the figure can be rotated to any desired angle of orientation. By providing the edges (49) of the slotted track (21) with lips (50) increased stability of the figure (28) can be achieved. Also, the porion of the bar (47) between the lips could be made of some shape other than a cylinder, such as an octagon, hexagon, or some other polygon, which would permit the selection of a variety if display angles for the figure, but prevent any rotation of a figure once it has been installed (not depicted).

In such an embodiment it would be equally advantageous to provide a means for convering any portions (51) of slotted track (21) which may permit light to escape from the optical shroud (23) in an undesired location along the slotted track (21). This objective could be achieved by two methods which can be employed alone or together. First, the shape and size of the concave surface of each light transmissive bar (40) can be selected to fill as much of the interior space of the opaque shroud (43) as possible, preventing such light from reaching the slotted track (21). This also enhances the efficiency of the display.

It is recognized however, that in order to preserve the versatility and interchangeability of design that is a primary advantage of this invention, it will not be possible to trap all of the light as this would require predetermined designs, patterns, and shroud lengths. This means that some untrapped light will reach the slotted track (21). In order to prevent such light from escaping out of the opaque shroud (23) and interfering with the desired figure pattern, the slotted track (21) can be fitted with the same sort of stripping as described in the electrical transmission embodiment of the invention. The interior portion (53) of the strip could further be adapted with mirrors (44) to enhance efficiency of the apparatus.

In order to facilitate the outdoor display of the illuminated figures (28), either embodiment of the invention may be further adapted with a means for mounting the figures (28) upon the shroud (20) and the shroud (20) to a wall (55) (or any desired surface). In describing this adaption, reference will be made to FIGS. 4 through 5

The upper surface (56) and lower surface (57) of the shroud (20) is made concave. The figures (26) for illuminated display are then further adapted with an upper holding element (58) and a lower holding element (59) each of which are shaped to fit snugly against the upper concave surface (56) and lower concave surface (57) of the shroud (20) respectively. By making the holding elements (58 and 59 ) flexible enough to permit them to be stretched over the upper shroud lip (62) and lower shroud lip (63), but with adequate tension to hold the figure, this apparatus permits the slidable illuminated figures (26) to be held securely at a given position along the sliding track (64).

A mounting member can be mounted upon the wall and also adapted with an upper holding member (65) and a lower holding member (66) very much similar to those on the illuminated figures (62 and 63), but long enough to provide adequate support to hold the entire apparatus in place upon the surface (55). Such a mounting member (67) could also be adapted with an electrical transmission mechanism, such as the prongs of a plug (68) in order to facilitate the flow of electricity into the shroud (20). This would be helpful with either embodiment of the invention as both would normally require an electrical supply to be delivered to the interior of the shroud.

In conjunction with the weatherstrip sections (35), which can be adapted to fill the otherwise open areas between the illuminated figures (26), the entire device can be mounted upon an outdoor surface (55) and protected from wind and moisture. Further adaptations of the mounting mechanism could be applied in order to prevent its theft or other vandalism.

Figure 5:
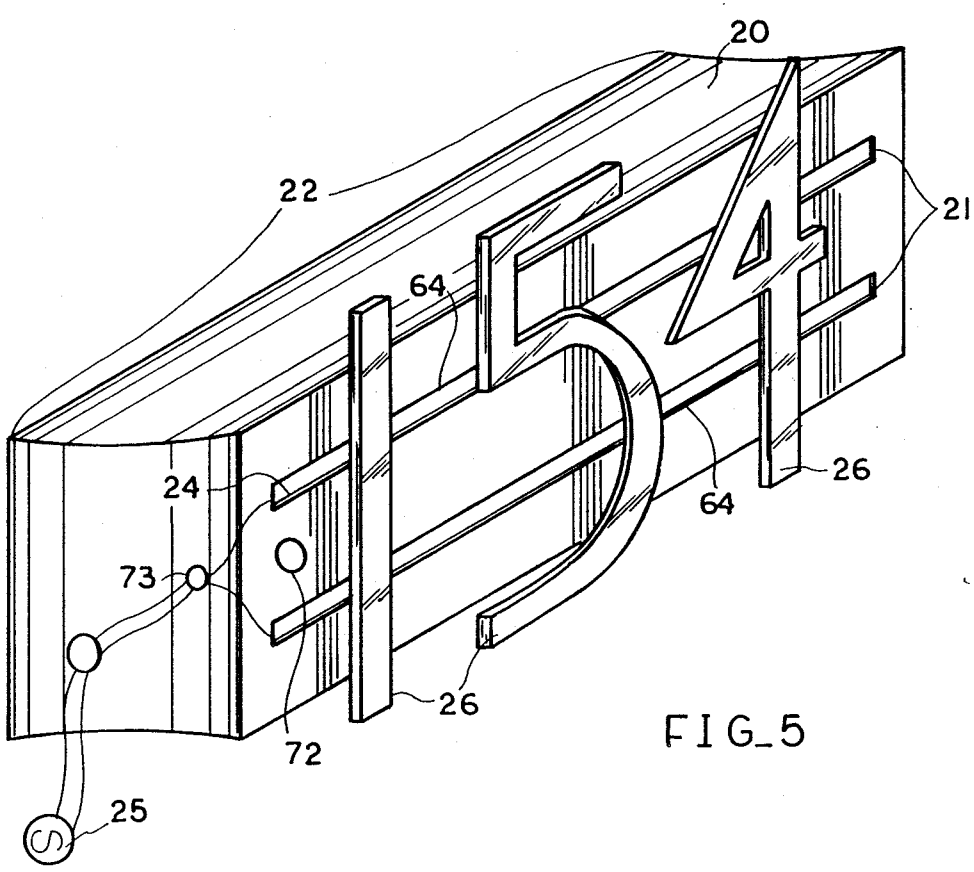
FIG. 5 depicts an oblique view of an elongated shroud additionally revealing internal shroud means for the transfer of electrical energy.

Since both alternative embodiments of the invention is described depend upon the use of electrical lighting, either a light within a opaque shroud or a series of lights to which electricity is transmitted through the shroud, it is possible to further adapt either version with a Photoelectric cell. FIG. 5 demonstrates this application. The optical receiving elements are of a photo-electrical cell (72) is placed in a position in the shroud exposing it in the direction of illumination. The photo-electrical cell (72) is equipped with an electric relay (73) which is adapted to switch the electrical power required to supply either system with the electrical power for lighting. By adapting the invention with such a device, it can be made to turn itself off and on as required to provide illumination of the sign during the hours of darkness.

Modification and variation can be made to the disclosed embodiments without departing from the subject and spirit of the invention as defined in the following claims. Such modifications and variations, as included within the scope of these claims, are meant to be considered part of the invention as described.

What is claimed is:

1. An apparatus for the illuminated display of figures, the apparatus further comprising;

an elongated shroud housing one or more generally parallel slotted tracks, each of which are generally parallel with the length of said elongated shroud, and are adapted to house one or more insulated electrical conductors;

said slotted tracks each being further adapted to house, within said slots, an exposed conducting surface;

said slotted tracks each being further adapted to be in electrical communication with one of said insulated electrical conductors;

said apparatus further comprising one or more display figures, said display figures comprising one or more holding members, said holding members being adapted to snugly fit within a slotted track and spaced such that each said holding member will spatially correspond with a corresponding slotted track;

said holding members each being further adapted to hold a said display figure for illumination, said display figure having one or more electrical lights positioned so as to define a letter, numeral, or other selected design;

said elongated shroud further having a concave upper surface and a concave lower surface;

and in which said figures further comprise an upper holding element and a lower holding element said holding members adapted to snugly fit upon the said upper and lower concave shroud surfaces.

2. The invention described in claim 1 which is further adapted to be mounted upon a surface, said surface having a mounting apparatus, said mounting apparatus further comprising an upper mounting member and a lower mounting member, said mounting members being designed to snugly house said upper and lower concave shroud surfaces.

3. The invention described in claim 2 in which said mounting apparatus has one or more electrical conducting members protruding therefrom and in which said shroud is further comprises corresponding ports to permit the conduction of electricity from said mounting apparatus electrical conducting members to said track electrical conductors.

4. The invention described in claim 2 in which said electrical light comprises a neon light shaped in the desired letter, numeral, or other selected design is in electrical communication with said mounting electrical conducting members.

5. The invention described in claim 4 in which said electrical light display comprises a series of incandescent light bulbs connected in electrical parallel and arranged so as to define the desired letter, numeral, or other selected design.

6. The invention described in claim 1 which is further adapted for automatic activation by the addition of a photoelectric cell, said photoelectric cell comprising a light detection system designed to measure the ambient light at or near the surface of said illuminated figures, but not the light emanating from said figures, said photoelectric cell further comprising an electrical relay for switching said illuminated figures off and on as desired.

7. An apparatus for the display of illuminated figures which permits said figures to be interchangeable and illuminated from a common source of optical energy, the apparatus comprising;

a figure mounting and illumination energy transfer means, said figure mounting and illumination energy transfer means comprising:

an elongated shroud through which energy may be transmitted in a suitable form for the illumination of said figures to appropriate points along the surface of the shroud;

a figure mounting means comprising one or more slotted mounting tracks running along the length of said elongated shroud;

one or more figures which are adapted to be mounted along said figure mounting tracks to be in optical communication with said illumination energy transfer delivery means, and to transmit said illumination energy as may be required;

in which said shroud is opaque and houses one or more sources of said visible light down the length of said shroud;

said shroud further, comprising at least one said slotted track running down the length of said shroud and further adapted to mount a figure for illumination by said light transmitted to said figure by a light transmission means, said light transmission means comprising a surface to absorb light from said sources of light and transmit a sufficient amount of light to said figure for illumination of said figure; and said light transmission means further comprising a portion of appropriate dimensions to snugly fit between the edges of said slotted track.

8. The invention described in claim 7 in which said shroud further comprising a concave upper surface and a concave lower surface, and in which said figures to be displayed further comprise an upper holding member and a lower holding member, said holding members being further adapted to snugly fit upon the said upper and lower concave shroud surfaces.

9. The invention described in claim 8 which is further adapted to be mounted upon a surface, said surface having a mounting apparatus, said mounting apparatus comprising an upper mounting member and a lower mounting member, said mounting members being designed to snugly house said upper and lower concave shroud surfaces.

10. The invention described in claim 7 wherein the light transmitting means comprises a light transmissive bar, said light transmissive bar having a concave surface adapted to accept maximum light from said light sources.

11. The invention described in 10 wherein said light transmissive bar has at said figure end a series of optical fibers, said optical fibers being positioned so as to project light form a configuration defining the desired letter, numeral, or other selected design.

12. The invention described in claim 7, which is further adapted for automatic activation by the addition of a photoelectric cell, said photoelectric cell comprising light detection system designed to measure the ambient light at or near the surface of said illuminated figures, said photoelectric cell further comprising an electrical relay for switching said sources of visible light off and on as desired.

13. An apparatus for the illuminated display of figures, the apparatus further comprising;

an opaque shroud having one or more slotted tracks, each of which are generally parallel with the length of said opaque shroud, said slotted tracks further having lips, said opaque shroud housing one or more sources of light down the length of said shroud and the interior of said opaque shroud further having reflecting devices directing light from said light sources towards said slotted track;

one or more figures for illumination, said figures each comprising a light transmissive bar, each said light transmissive bar having a surface adapted to receive light and transmit light down its length to an array of optical fibers at the opposite end of said light transmissive bar from said receiving surface;

each said light transmissive bar further comprising a portion designed to snugly fit within the slotted track of said opaque shroud in a manner such that each receiving surface of each said light transmissive bar is directed towards said light sources and the optical fibres are projected outside of said opaque shroud; and said optical fibers arranged into a configuration wherein the free ends of said optical fibers define a desired numeral, letter, or other design.

14. The invention described in claim 13 further comprising one or more strip members for the prevention of undesired light transmission from said slotted track, the strip members further comprising;

an interior side, said interior side adapted to fit between the said receiving surfaces of said light transmissive bars;

a portion adapted to snugly fit within said slotted track and completely fill any open areas between the portion of said light transmissive bar housed within the lips or ends of said slotted track; and an exterior side, said exterior side being opaque and of any color which is complementary to said illuminated figures or matching said opaque shroud.

15. The invention described in claim 14 in which said strip interior side further comprises one or more reflecting devices.

16. The invention described in claim 15 in which said opaque shroud is further adapted with a concave upper surface and a concave lower surface, and in which said figures to be displayed further comprise an upper holding member and a lower holding member, said holding members being further adapted to snugly fit upon the said upper and lower concave shroud surfaces.

* * * * *